US006056419A

United States Patent [19]

March

[11] Patent Number: 6,056,419

[45] Date of Patent: May 2, 2000

[54] HOLIDAY LIGHT DISPLAY DEVICE

[76] Inventor: Brad A. March, 3915 Alto Ave., Carrollton, Tex. 75007

[21] Appl. No.: 09/119,755

[22] Filed: Jul. 21, 1998

[51] Int. Cl.[7] ..... F21V 29/00

[52] U.S. Cl. ..... 362/249; 362/252; 362/806

[58] Field of Search ..... 362/123, 806, 362/249, 103, 252, 800; 40/124.02; 206/419, 420

[56] References Cited

U.S. PATENT DOCUMENTS

| | | | |
|---|---|---|---|
| 3,731,081 | 5/1973 | Yellin | 362/806 |
| 4,164,008 | 8/1979 | Miller et al. | 362/103 |
| 4,202,569 | 5/1980 | Thuringer | 289/18.1 |
| 4,308,572 | 12/1981 | Davidson et al. | 362/103 |
| 4,769,749 | 9/1988 | Felski | 362/252 |
| 4,966,793 | 10/1990 | Covell | 362/806 |
| 5,371,657 | 12/1994 | Wiscombe | 362/103 |
| 5,555,163 | 9/1996 | Pisani . | |
| 5,601,361 | 2/1997 | Lawrence . | |
| 5,624,181 | 4/1997 | Miller et al. | 362/252 |
| 5,709,462 | 1/1998 | Rumpel . | |

FOREIGN PATENT DOCUMENTS

WO8801360 2/1998 WIPO .

*Primary Examiner*—Thomas M. Sember
*Attorney, Agent, or Firm*—Harrison & Egbert

[57] ABSTRACT

A holiday light display device having a sheet of flexible material and a plurality of holiday light receiving apertures formed in the sheet in a desired pattern. The holiday light receiving apertures serve to insertably receive a holiday light therein. The sheet of flexible material is a generally flat sheet of polymeric material. The sheet of flexible material has a plurality of openings formed therein so as to extend in a pattern across the sheet. These openings are positioned respectively between adjacent holiday light receiving apertures. The holiday light receiving apertures include a slot which extends outwardly from the aperture and is formed through the sheet. The sheet includes a suitable mechanism for attachment to an external object. The holiday light is removably received within the holiday light receiving aperture such that a luminous portion of the holiday light extends outwardly of one side of the sheet. The cord to the luminous portion extends outwardly from the opposite side of the sheet.

12 Claims, 2 Drawing Sheets

HOLIDAY LIGHT DISPLAY DEVICE

TECHNICAL FIELD

The present invention relates to devices for mounting holiday lights. More particularly, the present invention relates to receptacles for placing holiday lights in a desired pattern. More particularly, the present invention relates to holiday light display devices whereby holiday lights can be formed in a desired pattern.

BACKGROUND ART

Strings of miniature lights with standardized sizes have become popular in recent years for decoration and ornamentation during a holiday season, such as Christmas, New Year's, Hanukkah, Independence Day, and the like—celebrations, as well as for purposes of ornamental displays, as in advertising or product promotion. Typically, these strings of lights are arranged on tree branches, along rooftop eaves and edges, around windows, on bushes and around product displays or business signage. These light strings operate with low wattage, small or miniature light bulbs, connected in a series along connecting wires which are properly insulated for either indoor or outdoor use. Through standardization of size and through means of mass production, these light strings have become relatively inexpensive to produce and operate with a low amount of electricity for highly visible, pinpoint illumination.

Unfortunately, it is often difficult for artistic individuals to properly arrange such lights. It is difficult to string the lights in such a manner that the lights are evenly spaced from one another. Often, continual adjustments are necessary so as to allow the lights to be spaced in a desired pattern. Under certain circumstances, the long lengths of wires which extend throughout the string of light bulbs becomes tangled and makes arrangement, for artistic purposes, even more difficult. This arrangement of holiday lights becomes particularly difficult when the holiday lights are applied to bushes, tree trunks, poles, and pillars. After the lights have been applied and artistically installed on such items, the long strand of electrical line will often become tangled when the lights are removed for storage. During a subsequent year, it is necessary to remove the lights, untangle the lights, and then reapply the lights in the desired pattern. As such, a need has developed so as to provide a system whereby the light bulbs can be displayed in a desired even pattern in a simple and easy manner while preventing the problem of the tangling of the light cord.

In the past, various U.S. patents have issued relating to such techniques for displaying such lights. For example, U.S. Pat. No. 5,555,163, issued on Sep. 10, 1996 to R. R. Pisani, describes a miniature light string display container for selectively displaying a plurality of light bulbs of a miniature light string in a desired arrangement. This container includes a front display panel having an array of regularly spaced mounting openings threrethrough. These openings are sized for securely receiving light bulbs of a light string at least partially therethrough in a desired arrangement or pattern which is selectable on the array of mounting openings. The display container also includes a reversibly openable entry panel with a closed position and an open position. Electrical connection wires extend through the display container, when closed, for connecting the string of lights to an electrical power source so that the pattern of inserted light bulbs is illuminated.

U.S. Pat. No. 5,709,462, issued on Jan. 20, 1998 to D. D. Rumpel, describes a mounting apparatus for conventional decorative light strings. This device includes a flexible open mesh sheet with spaced interstices extending between a front and a back side of the sheet. A light clip base member and a transparent lens member having a bulb receiving recess are also included for attachment to the sheet. One of the members includes a fastener configured to releasably secure a decorative light bulb and socket with the light bulb received within the bulb receiving recess. The fastener is shaped to releasably join the light clip base member and transparent lens member on opposite sides of the open mesh sheet through the open mesh of the sheet with the transparent lens member projected from the front side of the sheet.

U.S. Pat. No. 5,601,361, issued on Feb. 11, 1997 to L. Lawrence, describes a celebration electric light net. This movable and flexible net is arranged in a pattern. This pattern is defined by a plurality of parallel strands having eyelets therein to releasably engage and hold lamps in a light string. The net, while supporting an attached light string, can be draped to any contour determined by a supportive surface and can be positioned in a deployed pattern with that contour or stored for later use.

International Publication No. WO 88/01360, published on Feb. 25, 1998 to M. Janko et al., teaches an illuminated article in the form of a garment which includes an electrically conductive harness mounted at predetermined locations on the housing which receives a plurality of illumination devices. A pair of electrical conductors mounted in an elongated string are securable within the housing in engagement with the leads of the light emitting diodes. An electrical power source includes a battery and an on/off switch which is also mounted in the articles and receives one end of the electrical conductors in the harnesses to connect the illumination devices to the battery for selectively illuminating the illumination devices.

It is an object of the present invention to provide a holiday light display device which keeps the lights in a uniform pattern.

It is another object of the present invention to provide a holiday light display device which keeps the string of lights in an untangled arrangement.

It is a further object of the present invention to provide a holiday light display device which serves to allow for the lengthy storage of a string of lights.

It is a further object of the present invention to provide a holiday light display device which allows for easy light application to bushes, tree trunks, poles, pillars, and the like.

It is a further object of the present invention to provide a holiday light display devices which is easy to use, relatively inexpensive, and easy to manufacture.

These and other objects and advantages of the present invention will become apparent from a reading of the attached specification and appended claims.

SUMMARY OF THE INVENTION

The present invention is a holiday light display device that comprises a sheet of flexible material and a holiday light receiving means formed on the sheet for insertably receiving a holiday light therein. The sheet of flexible material is a generally flat sheet of polymeric material. This sheet of flexible material has a plurality of openings formed so as to extend in a pattern across the sheet. The plurality of openings are respectively positioned between adjacent holiday light receiving means. In the preferred embodiment of the present invention, each of the plurality of openings has a generally diamond-shaped configuration. In this preferred embodiment, each of the holiday light receiving means is positioned adjacent respective comers of the diamond-shaped configuration.

In the present invention, the holiday light receiving means comprises a plurality of such holiday light receiving means extending across the sheet in spaced relationship. Specifically, each of the plurality of holiday light receiving means comprises an aperture extending through the sheet. The aperture has a slot extending outwardly from the aperture which is formed through the sheet. The aperture has a perimeter with a first slot, a second slot, a third slot and a fourth slot extending outwardly of this perimeter. Each of these slots is offset by 90 degrees from an adjacent slot.

The sheet can have means thereon which allows the sheet to be attached to an external object or attached to itself. This means for attachment can be a plurality of holes formed in a spaced pattern along at least one edge of the sheet or a plurality of protuberances extending outwardly of an edge of the sheet.

The aperture and the slots should be sufficiently flexible so as to allow a holiday light to be inserted thereinto. The holiday light is received within such an aperture and a slot such that the luminous portion of the holiday light extends outwardly of one side of the sheet. The holiday light includes a cord which extends outwardly from an opposite side of the sheet.

DETAILED DESCRIPTION OF THE INVENTION

Figure 1:
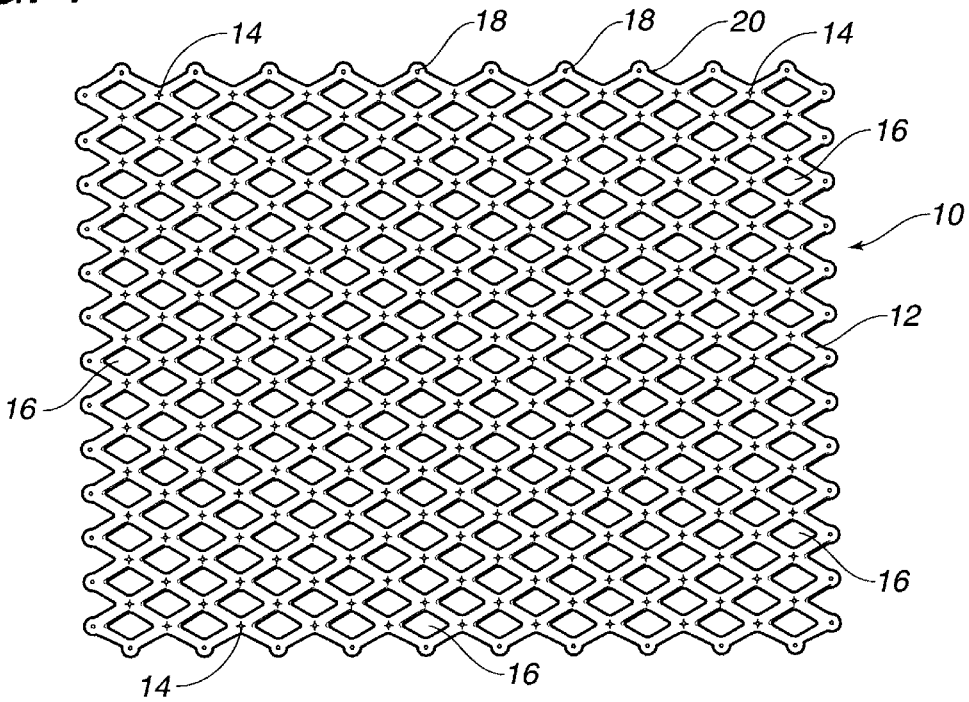
FIG. 1 is a plan view of the holiday light display device in accordance with the preferred embodiment of the present invention.

Referring to FIG. 1, there is shown at 10 the holiday light display device in accordance with the teachings of the present invention. The holiday light display device 10 includes a flexible sheet 12 and a holiday light receiving means 14 formed in the sheet. The holiday light receiving means 14 serves to insertably receive a holiday light therein.

In the present invention, the sheet of flexible material is a generally flat sheet of polymeric material. This sheet 12 includes a plurality of openings 16 formed so as to extend in a pattern across the sheet. As can be seen in FIG. 1, this pattern includes a plurality of generally parallel rows extending horizontally across the sheet. Each of the openings 16 forms a zig-zag pattern within vertical rows extending down the sheet. In one horizontal row, the opening 16 will be in a spaced position between two openings 16 in an adjacent horizontal row. Similarly, in a vertical row of such openings 16, an opening in one row will be positioned generally in an area between openings in an adjacent vertical row. As can be seen in FIG. 1, the holiday light receiving means is positioned between adjacent openings 16.

In the preferred embodiment of the present invention, each of the openings 16 has a generally diamond-shaped configuration. As can be seen in FIG. 1, the holiday light receiving means 14 is positioned between respective corners of the diamond-shaped configuration.

As can be seen in FIG. 1, the holiday light receiving means 14 includes a plurality of holiday light receiving apertures extending across the sheet 12 in spaced relationship. These apertures extend through the thickness of the sheet 12. As can be seen in FIG. 1, the apertures 14 will be positioned between adjacent openings 16 in the respective horizontal and vertical rows of such openings 16. The holiday light receiving apertures 14 will also extend in linear horizontal rows and in linear vertical rows across the sheet. The holiday light receiving aperture 14 of one horizontal row will be spaced between two holiday light receiving apertures 14 in an adjacent horizontal row. Similarly, a holiday light receiving aperture 14 in one vertical row will be spaced between two holiday light receiving apertures 14 in an adjacent vertical row.

In FIG. 1, it can be seen that a plurality of holes 18 are formed along an upper edge 20 of the sheet 12. These holes 18 facilitate the ability to attach the sheet 12 to an external object such as a bush, a tree trunk, a pole, a pillar, or other objects. These holes 18 can extend along a single edge or they can extend along several of the edges of the sheet 12. For example, the holes 18 along the top edge of the sheet 12 can be connected to the holes extending along the bottom edge of sheet 12. Alternatively, the holes along the right-hand side of the sheet can be secured to the holes formed along the left-hand side of the sheet. A suitable string, thread, clip of fastener can be used to connect the holes together. Alternatively, other means can be also used so as to facilitate the ability to attach the sheet 12 to an external object. Conventional straps, bands, clips, or other related items can be used so as to securely mount the sheet 12 to the external object. Still further, and alternatively, the holes on any of the plurality of sheets can be joined together in edge-to-edge or side-by-side relationship. This allows the pattern of lights to be extended over a large area over several sheets.

Figure 2:
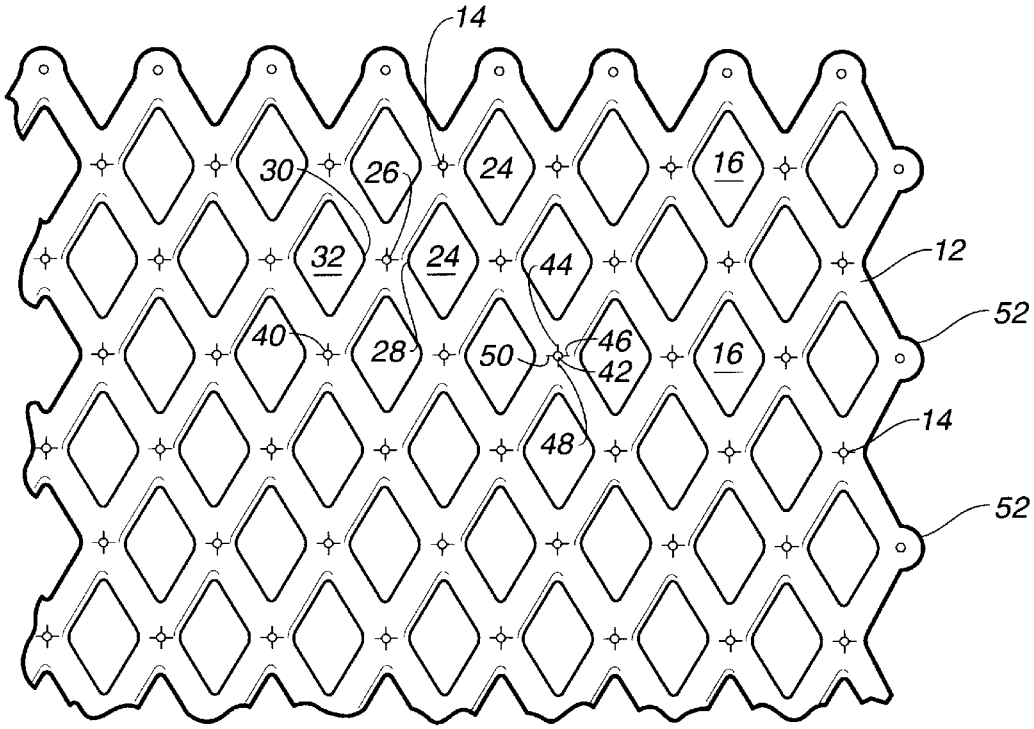
FIG. 2 is a close-up plan view of the arrangement of apertures and openings on the holiday light display device of the present invention.

FIG. 2 is a detailed isolated view of the openings 16 and the apertures 14. As can be seen in FIG. 2, there are a relatively large number of such openings 16 which extend across the sheet 12. Each of the openings 16 has a generally diamond-shaped configuration. The holiday light receiving aperture 14 is positioned between the comers of one opening 24 and a corner of another opening 26. Also, it can be seen that a single holiday light receiving aperture 26 is positioned between a corner 28 of opening 24 and a corner 30 of an opening 32. The openings 16 contribute to the flexibility of the flexible sheet 12, allows the flexible sheet 12 to be attached to external objects, and minimizes the plastic material requirements of the sheet 12.

The holiday light receiving aperture 14 includes at least one slot extending outwardly of a perimeter 40 of the holiday light receiving aperture 14. In particular, four slots are formed at equal intervals around the perimeter 40. With reference to a single holiday light receiving aperture 42, it can be seen that there is a first slot 44, a second slot 46, a third slot 48, and a fourth slot 50. Each of the slots 44, 46, 48 and 50 are offset, from each other, by approximately 90 degrees. The slots 44, 46, 48 and 50 allows the aperture 14 to suitably expand so as to engage a holiday light inserted therein.

In FIG. 2, it can be seen that protuberances 52 are formed along one edge of the sheet 12 so as to facilitate the ability to attach the sheet 12 to an external surface.

Figure 3:
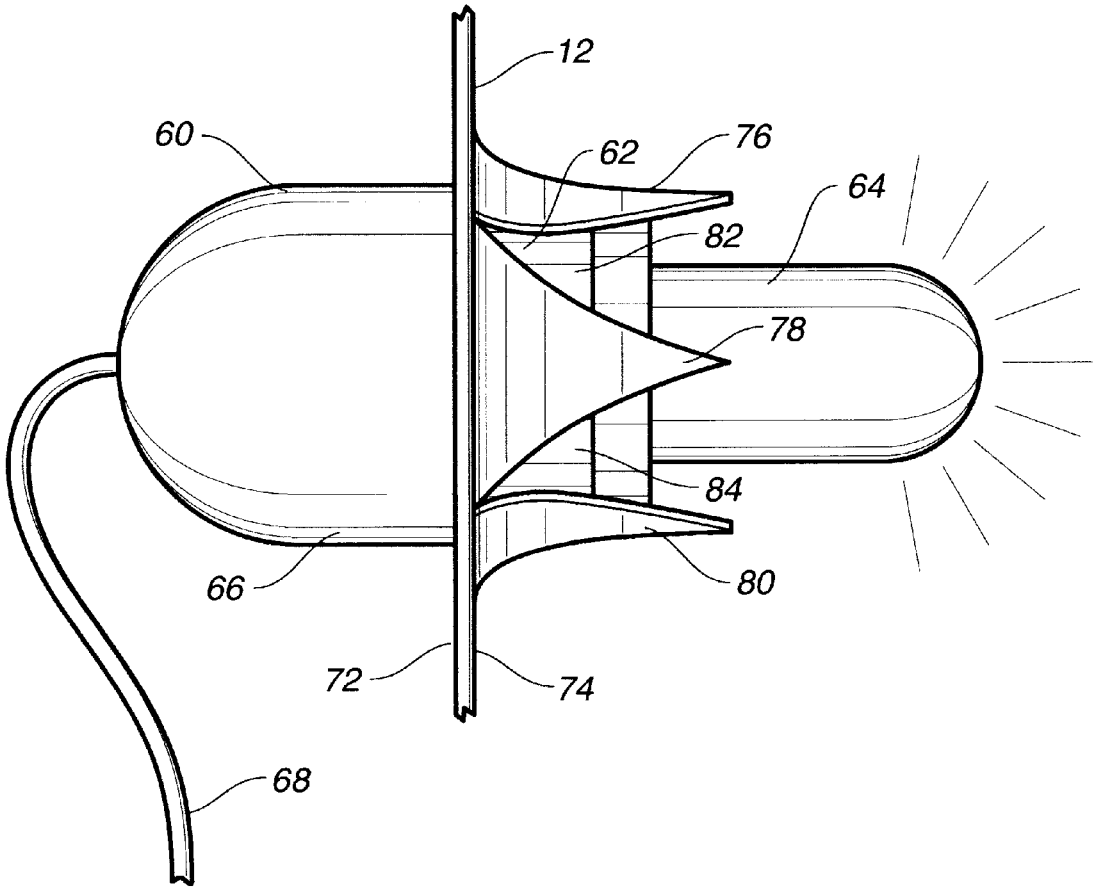
FIG. 3 is a greatly magnified isolated side view of a holiday light as received within the holiday light receiving means of the preferred embodiment of the present invention.

Referring to FIG. 3, it can be seen how a holiday light 60 is inserted within the holiday light receiving aperture 62 formed on the sheet 12. The holiday light 60 includes a luminous portion 64, a socket 66, and a cord 68. The holiday light 60 is inserted through the aperture 62 such that the socket 66 is wedged within the aperture 62. The cord 68 extends outwardly from side 72 of sheet 12. The luminous portion extends outwardly from the opposite side 74 of sheet 12. As can be seen, the flaps 76, 78 and 80 which are formed by the respective slots 82 and 84 of the holiday light receiving aperture 62 fit against the socket 66 of holiday light 60 so as to retain the luminous portion 64 in a position extending outwardly of the surface 74 of sheet 12. The flaps 76, 78 and 80 expand outwardly when the luminous portion 64 is placed into the aperture 62 and pushed through the sheet 12. As such, the cord 68 will be stowed in a convenient location on the opposite side 72 of the sheet 12.

The present invention utilizes a flexible, plastic net-like sheet for positioning lights in a uniform and an untangled pattern. The present invention allows for an unlimited number of display patterns. The present invention provides an easy way for storing the lights. After use, the lights can be stored until it is time to display the holiday lights once again. When the lights and the sheet are removed from storage, the sheet can be opened such that the lights will assume the same pattern into which they had been previously stowed.

The foregoing disclosure and description of the invention is illustrative and explanatory thereof. Various changes in the details of the illustrated construction may be made within the scope of the appended claims without departing from the true spirit of the invention. The present invention should only be limited by the following claims and their legal equivalents.

I claim:

1. A holiday light display device comprising:

a flat sheet of polymeric flexible material;

a plurality of holiday light receiving means formed on said sheet, said plurality of holiday light receiving means for insertably receiving a holiday light therein, each of said plurality of holiday light receiving means being an aperture formed interior of outer edges of said flat sheet; and a plurality of non-light-receiving openings formed in said sheet of flexible material so as to extend in a pattern across said sheet, said plurality of non-light-receiving openings being respectively positioned between adjacent holiday light receiving means, each of said plurality of non-light-receiving openings having a diamond-shaped configuration.

2. The device of claim 1, each of said holiday light receiving means being positioned adjacent respective corners of said diamond-shaped configuration.

3. The device of claim 1, said holiday light receiving means comprising:

a plurality of holiday light receiving means extending across said sheet in spaced relationship.

4. The device of claim 3, said plurality of holiday light receiving means being arranged in parallel rows extending across said sheet.

5. The device of claim 1, said aperture having a slot extending outwardly from said aperture, said slot formed through said sheet.

6. The device of claim 5, said aperture and said slot being sufficiently flexible so as to allow a holiday light to be inserted thereinto.

7. The device of claim 1, further comprising:

a holiday light removably received within said holiday light receiving means such that a luminous portion of said holiday light extends outwardly of one side of said sheet.

8. The device of claim 7, said holiday light having a cord connected to said luminous portion, said cord extending outwardly of an opposite side of said sheet.

9. The device of claim 7, said holiday light having a socket connected to said luminous portion and connected to said cord, said socket being affixed within said aperture.

10. A holiday light display device comprising:

a sheet of flexible material; and a plurality of apertures formed in and extending through said sheet, each of said plurality of apertures adapted to insertably receive a holiday light therein, each of said apertures having a circular perimeter, each of said apertures having a first slot extending radially outwardly of said circular perimeter, each of said apertures having a second slot extending radially outwardly of said circular perimeter, each of said apertures having a third slot extending radially outwardly of said circular perimeter, and each of said apertures having a fourth slot extending radially outwardly of said circular perimeter, said slots and said apertures being coplanar with said sheet.

11. The device of claim 10, said first slot being offset by 90 degrees from said second slot, said second slot being offset by 90 degrees from said third slot, said third slot being offset by 90 degrees from said fourth slot, said fourth slot being offset by 90 degrees from said first slot.

12. A holiday light display device comprising:

a planar sheet of flexible material;

a holiday light receiving means formed on said sheet, said holiday light receiving means for insertably receiving a holiday light therein; and means for attachment to an external surface formed on said planar sheet, said means for attachment to an external surface being holes formed in an spaced pattern along at least one edge of said sheet, said means for attachment comprising a plurality of protuberances extending outwardly from said at least one edge of said sheet, said holes each being formed in respective protuberances of said plurality of protuberances, said plurality of protuberances being coplanar with said planar sheet.

* * * * *